US009802425B2

(12) United States Patent
Seki et al.

(10) Patent No.: US 9,802,425 B2
(45) Date of Patent: Oct. 31, 2017

(54) PRINTING DEVICE AND PRINTING METHOD

(71) Applicant: MIMAKI ENGINEERING CO., LTD., Nagano (JP)

(72) Inventors: Akifumi Seki, Nagano (JP); Kazuya Nozaki, Nagano (JP); Hironori Hashizume, Nagano (JP); Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/028,025

(22) PCT Filed: Oct. 8, 2014

(86) PCT No.: PCT/JP2014/076972
§ 371 (c)(1),
(2) Date: Apr. 8, 2016

(87) PCT Pub. No.: WO2015/053327
PCT Pub. Date: Apr. 16, 2015

(65) Prior Publication Data

US 2016/0279972 A1 Sep. 29, 2016

(30) Foreign Application Priority Data

Oct. 9, 2013 (JP) ..... 2013-211840
Mar. 25, 2014 (JP) ..... 2014-061899

(51) Int. Cl.
*B41J 11/00* (2006.01)
*B41J 2/21* (2006.01)

(52) U.S. Cl.
CPC ..... *B41J 11/0015* (2013.01); *B41J 2/21* (2013.01); *B41J 11/002* (2013.01)

(58) Field of Classification Search
CPC ..... B41J 2/2114
See application file for complete search history.

(56) References Cited

U.S. PATENT DOCUMENTS 4,196,247 A * 4/1980 Wiesman ..... C08J 7/04 427/412.2
6,406,138 B1 * 6/2002 Gore ..... C09D 11/40 347/100

(Continued)

FOREIGN PATENT DOCUMENTS

JP 2004-195451 7/2004
JP 2006227400 A * 8/2006

(Continued)

OTHER PUBLICATIONS

Machine generated English translation of JP 2006-227400A to Morita et al., "Electrophotographic Photoreceptor, Method for Manufacturing Same and Image Forming Apparatus With the Electrophotographic Photoreceptor"; obtained via https://www4.j-platpat.inpit.go.jp on Nov. 14, 2016; 19 pp.*

(Continued)

*Primary Examiner* — Shelby Fidler
(74) *Attorney, Agent, or Firm* — JCIPRNET

(57) ABSTRACT

A printing device and a printing method, which are by ink-jet technique an overcoat layer using an ink consisting of more suitable ingredients, are provided. The printing device is for performing printing by ink-jet technique, including: a color ink head being an inkjet head that forms a color ink layer on a medium using a color ink; an overcoat head being an inkjet head that forms an overcoat layer that covers the color ink layer; and a curing agent head being an inkjet head that discharges ink droplets of a curing agent, the curing agent being a liquid for curing an ink in the overcoat layer. The overcoat head discharges ink droplets of an ink prepared (Continued)

by dispersing in an organic solvent a curable material that is cured in reaction to the curing agent.

13 Claims, 8 Drawing Sheets

(56) References Cited

U.S. PATENT DOCUMENTS

2003/0202026 A1* 10/2003 Smith ..... B41J 2/2114 347/12
2004/0207705 A1* 10/2004 Ozawa ..... B41J 2/01 347/101
2005/0065235 A1* 3/2005 Bauer ..... C09D 11/40 523/160
2007/0176960 A1* 8/2007 Tsuruko ..... B41J 2/2114 347/21
2008/0295731 A1* 12/2008 Odell ..... C09D 11/36 106/31.13
2011/0070372 A1* 3/2011 Faucher ..... C09D 11/101 427/256
2014/0132658 A1* 5/2014 Suzuki ..... B41J 2/2114 347/16

FOREIGN PATENT DOCUMENTS

JP 2007-521356 8/2007
JP 2009-196352 9/2009
WO 02/087886 11/2002

OTHER PUBLICATIONS

"International Search Report (Form PCT/ISA/210)", dated Jan. 13, 2015, with English translation thereof, pp. 1-4.
http://www.mimaki.co.jp, retrieved on Apr. 7, 2016, with corresponding English page (http://eng.mimaki.co.jp) thereof, "Mimaki Engineering Co., Ltd."

* cited by examiner

| | Base material | Curing agent |
|---|---|---|
| Type | Modified acrylic-based | Polymer-based |
| Ingredients | Glycol ether solvent 75～85<br>Acrylic resin 5～15<br>Isobutyl acetate 3.3<br>Xylene 1.7<br>Ethylbenzene 0.8 | Glycol ether solvent 75～85<br>Polymer-based curing agent 10～20<br>Hydrocarbon-based solvent 1～5<br>Trimethylbenzene Less than 1%<br>1,3,5-trimethylbenzene Less than 1% |
| The Ordinance on Prevention of Organic Solvent Poisoning | The Act not applicable<br>Containing the substances in less than the specified quantity | The Act not applicable<br>Not containing the substances |
| Fire Service Act | Hazardous Materials, Category IV, Class II petroleums<br>Water insolubility, Hazard Class III | Hazardous Materials, Category IV, Class II petroleums<br>Water insolubility, Hazard Class III |
| PRTR Act | The Act applicable | The Act not applicable<br>Containing the substances in less than the specified quantity |

FIG.2

Printing
<conditions>

| | |
|---|---|
| Printer | : JV33-160 |
| Resolution | : 540x1080 |
| Pass number | : 12 passes |
| Printing direction | : Two directions |
| High-speed mode | : ON |
| Heater temperature | : Pre 35°C<br>Printing 35°C<br>After 35°C |
| Adding extra layer | : Twice |
| Medium | : Vinyl chloride (SPC-0706) |

FIG.3A

| Printing density | Base material (lower column - applied quantity for two layers) | 100% 28mL/m^2 | | | | | |
|---|---|---|---|---|---|---|---|
| | Curing agent (lower column - applied quantity for two layers) | 0% | 5% 1.2mL/m^2 | 10% 2.4mL/m^2 | 15% 3.6mL/m^2 | 20% 4.8mL/m^2 | 40% 9.6mL/m^2 |
| Blocking | Medium wound and left at rest overnight | ○ | ○ | ○ | ○ | × | × |
| | Medium further left at rest for three hours under the load of approximately300g / 100 cm^2 | × | ○ | ○ | ○ | × | × |
| Coating condition | Prior to weather resistance test | | | | | | – |
| | After a year-long weather resistance test | | | | | | – |

FIG.3B

PRINTING DEVICE AND PRINTING METHOD

CROSS-REFERENCE TO RELATED APPLICATION

This application is a 371 application of the international PCT application serial no. PCT/JP2014/076972, filed on Oct. 08, 2014, which claims the priority benefit of Japan application no. 2013-211840, filed on Oct. 9, 2013; and Japan application no. 2014-061899, filed on Mar. 25, 2014. The entirety of each of the above-mentioned patent applications is hereby incorporated by reference herein and made a part of this specification.

TECHNICAL FIELD

The present invention relates to a printing device and a printing method.

BACKGROUND ART

In recent years, inkjet printers are spreading into a broad range of applications including printed matters printed for outdoor use such as outdoor advertising (for example, Non-Patent Document 1). In such a printed matter, a material for overcoat may be applied to an image printed thereon to improve weather resistance. The means for applying the overcoat material may include sprays, brushes, and dip coating.

CITATIONS LIST

Non-Patent Document

Non-Patent Document 1: Internet URL http://www.mimaki-.co.jp

SUMMARY OF INVENTION

Technical Problems

When an overcoat material is applied using any one of these means conventionally employed, coating irregularity may be likely to occur, possibly degrading the appearance of a printing result. Moreover, for example, the overcoat material may be needlessly spread on image-unprinted parts, leading to overconsumption of the overcoat material. Further, aside from an inkjet printer used to render images, an apparatus may be additionally required that is solely for the purpose of applying the overcoat material to the images, and such an apparatus may require complicated maintenance.

To address these issues, clear inks of ultraviolet curing type may optionally be used as the overcoat material, in which case the inkjet printers are used to apply the overcoat clear inks. In this instance, by irradiating the applied clear ink with ultraviolet to cure an image-coating overcoat layer, a resulting printed matter may be improved in weather resistance. Using inkjet heads may reduce the risk of coating irregularity, allowing the clear inks to evenly spread. Using inkjet heads is further useful in that the overcoat material may be selectively applied to sections of a printed matter in need of overcoat, economizing on the overcoat material consumed. In addition to these merits, image rendering and overcoating may be performed by one inkjet printer, thereby saving time and labor for maintenance.

However, the inventors were deeply committed to various studies and researches and found out difficulties in increasing the strengths of overcoat layers formed of ultraviolet-curable clear inks. The inventors also found out that the strengths of cured overcoat layers were greatly affected by a variety of additives added in large quantities to the clear inks of ultraviolet curing type.

Based on these facts, inks consisting of more suitable ingredients are desirably used when overcoat layers are formed by ink-jet technique. The present invention provides a printing device and a printing method that may overcome the above-mentioned problems.

Solutions to Problems

The inventors further earnestly deliberated and studied on effective methods for forming overcoat layers by ink-jet technique. Then, they were led to the idea of forming overcoat layers using not ultraviolet curing type inks but solvent-containing clear inks. First, such a clear ink was prepared as the overcoat material by dissolving clear ink materials in an organic solvent. Then, the overcoat layer was formed of this ink. This may be expected to reduce any undesired additives of the clear ink to an appropriate extent.

On the other hand, the tests performed revealed that merely dissolving the clear ink materials in an organic solvent would possibly cause various problems. Specifically, in the event of using such a clear ink, removing the organic solvent by volatilization, and more importantly, fully solidifying the clear ink materials are necessary in order to obtain a weather-resistant overcoat layer.

To adequately improve the overcoat layer in weather resistance, a large quantity of overcoat materials may need to be applied. This may naturally require more time to fully solidify all of the clear ink materials. The overcoat layer on the ink layers formed of discharged ink droplets may not be hard enough if its materials are dried simply by heating using a heater. It would be impractical to wait for the overcoat layer to adequately harden, taking too long before the overcoat layer is finally obtained. Then, it may become difficult to finish the formation of the overcoat layer within a reasonable time frame for practical use.

The inventors, in their pursuit of ways to solve these problems, contemplated that a two-part curable composition using a curing agent to cure the clear ink would certainly be more suitable for the formation of the overcoat layer than simply dissolving the clear ink materials in an organic solvent. To address these conventional issues, the present invention provides for the following structural and technical configurations.

[Configuration 1]

A printing device for performing printing by ink-jet technique, including: a color ink head being an inkjet head that forms a color ink layer on a medium using a color ink; an overcoat head being an inkjet head that forms an overcoat layer that covers the color ink layer; and a curing agent head being an inkjet head that discharges ink droplets of a curing agent, the curing agent being a liquid for curing an ink in the overcoat layer, wherein the overcoat head discharges ink droplets of an ink prepared by dispersing in an organic solvent a curable material that is cured in reaction to the curing agent.

According to this configuration wherein the ink of the overcoat layer is cured in reaction to the curing agent, the overcoat layer that excels in weather resistance may be speedily formed. As compared to using inks of ultraviolet curing type as the overcoat layer ink, additives added to the ink may be reduced to an appropriate extent. In addition to that, the overcoat layer may be further improved in strength. Hence, the overcoat layer may be formed by ink-jet technique using an ink consisting of more suitable ingredients.

The overcoat layer may be a clear layer formed of the clear ink. The overcoat layer covers and protects the color ink layer. The ink used in the overcoat head may preferably be an ink including an organic solvent as a main ingredient. As used herein, the ink including an organic solvent as a main ingredient may refer to an ink containing an organic solvent in a content of greater than or equal to 50% by weight.

Examples of the organic solvent usable in the ink for the overcoat head may include organic solvents selected from Hazardous Materials, Category IV, Class III petroleums specified in the Fire Service Act. By thus using an organic solvent similar to the ones used in the known solvent inks, the ink droplets may be reliably discharged in a reliable manner. The evaporation rate of the organic solvent in the ink may be decelerated to prevent the ink from drying near the nozzles of the inkjet head.

Examples of the organic solvent usable in the ink for the overcoat head may include organic solvents selected from Hazardous Materials, Category IV, Class II petroleums specified in the Fire Service Act. By selecting an organic solvent from these examples, the organic solvent included in a large quantity of the ink applied may still be removed by volatilization in a shorter period of time.

[Configuration 2]

The overcoat head discharges ink droplets of a solvent ink containing a hydrophobic organic solvent. By using such a solvent ink, the overcoat layer may be favorably formed.

As used herein, the hydrophobic organic solvent may refer to a non-polar organic solvent. Examples of the hydrophobic organic solvent may include organic solvents similar to or identical to the ones used in the known solvent inks.

[Configuration 3]

The overcoat head discharges ink droplets of a colorless and transparent ink. By using such an ink, the overcoat layer may be favorably formed.

[Configuration 4]

The overcoat head discharges ink droplets of an ink containing an ultraviolet absorbent that absorbs ultraviolet rays. By using such an ink, the overcoat layer may be further improved in weather resistance.

When a printed matter is displayed outdoors, the surface of the printed matter is mostly very susceptible to ultraviolet rays. To improve the overcoat layer in weather resistance, therefore, the overcoat layer may effectively be formed of an ultraviolet absorbent-containing ink. However, when, for example, the overcoat layer is formed of an ink of ultraviolet curing type, irradiating the ink with ultraviolet is necessary to cure the ink. Therefore, inks curable by ultraviolet irradiation are normally allowed to contain no ultraviolet absorbent.

In the event of using an ink prepared by dispersing a curable material in an organic solvent (for example, solvent ink), on the other hand, ultraviolet irradiation is unnecessary for fixing the ink. Such an ink, therefore, may contain an ultraviolet absorbent. Using an ink of this type, therefore, may effectively reduce possible damage to the overcoat layer caused by ultraviolet rays. In addition to that, the overcoat layer may be further improved in weather resistance.

Adding the ultraviolet absorbent in excess to the ink may involve the risk of adversely affecting the strength of the overcoat layer. Some of the ultraviolet absorbents may generate heat through absorption of ultraviolet rays. The generated heat may impose a negative impact on the weather resistance of an obtained printed matter. There, the content of the ultraviolet absorbent may preferably be approximately 1% (for example, approximately 0.1 to 3%, or more preferably approximately 0.5 to 1.5%).

[Configuration 5]

The curing agent head discharges droplets of a curing agent mixed with an ultraviolet absorbent that absorbs ultraviolet rays. According to this configuration, the overcoat layer containing the ultraviolet absorbent may be favorably formed. In addition to that, the overcoat layer may be further improved in weather resistance.

[Configuration 6]

The overcoat head discharges ink droplets of an ink containing an acrylic resin as the curable material, and the curing agent head discharges droplets of a polymer-based curing agent. According to this configuration, the ink for the overcoat layer may be more properly cured with the aid of the curing agent.

[Configuration 7]

The color ink head discharges ink droplets at positions on a medium by repeatedly performing a main scan in which the color ink head discharges ink droplets while moving in a main scanning direction previously set and a sub scan in which the color ink head moves relative to the medium in a sub scanning direction orthogonal to the main scanning direction, the overcoat head is disposed at a position displaced from the color ink head in the sub scanning direction, and the curing agent head is disposed alongside the overcoat head in the main scanning direction.

The color ink head may perform the sub scan at intervals between the main scans. The overcoat head and the curing agent head perform the main and sub scans simultaneously with the color ink head. The overcoat head and the curing agent head are disposed at positions displaced from the color ink head in the sub scanning direction to perform each main scan for a region where the main scan by the color ink head has been completed.

Accordingly, the overcoat layer may be favorably formed on the color ink layer. In addition to that, each main scan may provide for adequate contact between the curing agent and the ink for the overcoat layer, allowing the overcoat layer ink to be properly cured.

[Configuration 8]

The printing device further includes: a heater, heating the medium so as to remove the organic solvent from the ink included in the overcoat layer by volatilization, wherein the color ink used in the color ink head is fixable on the medium by drying, the heater heats at least a first landing position being a landing position on the medium of the ink droplets discharged from the color ink head and a second landing position being a landing position on the medium of the ink droplets discharged from the overcoat head, and the medium is heated so that a temperature at the second landing position is lower than a temperature at the first landing position.

In order to prevent ink smearing when the color ink used is an ink fixable on the medium by drying, ink droplets of the ink are desirably dried immediately after they have landed on the medium. To quickly dry the ink, therefore, the heating temperature at the first landing position of the color ink is desirably a high temperature at or above a certain degree.

According to the printing device wherein the overcoat layer ink is cured with the aid of the curing agent, if the heating temperature at the ink droplet landing position is too high, the ink may be dried too soon to be adequately mixed with the curing agent. Then, curing of the ink included in the overcoat layer may be inadequate. On the other hand, the clear ink-based overcoat layer, which is an ink layer formed of a monochrome (or colorless) ink, is free from the trouble of smearing. This ink, therefore, may be dried over time in contrast to the color ink.

According to the configuration 8, the heating temperature at the second landing position of the ink droplets to form the overcoat layer ink is relatively lower to prevent the ink from drying before being adequately mixed with the curing agent. This may effectuate complete cure of the ink, enabling the overcoat layer that excels in weather resistance to be favorably formed.

A suitable example of the color ink may be a solvent ink. Other possible examples of the color ink may include latex inks and solvent UV inks.

[Configuration 9]

The printing device further includes: a medium transport unit, transporting the medium and moving the medium relative to the overcoat head and the curing agent head; a downstream heater, heating the medium at a downstream side compared to the overcoat head and the curing agent head in a transport direction in which the medium is transported by the medium transport unit; and a medium take-up unit, winding up the medium at a downstream side compared to the downstream heater in the transport direction, wherein the downstream heater heats the medium so that the overcoat layer has a temperature higher than or equal to a glass transition point, and the medium take-up unit winds up the medium after the temperature of the overcoat layer drops to a temperature lower than the glass transition point.

An example of the downstream heater may be an after heater. As used herein, the after heater refers to a heater disposed more downstream than the overcoat head and the curing agent head in the transport direction of the medium. This heater heats a region on the medium where the color ink layer and the overcoat layer have already been formed. Rephrasing for clarity "the medium take-up unit winds up the medium after the temperature of the overcoat layer drops to a temperature lower than the glass transition point", the medium take-up unit winds up the medium after the temperature at a portion of the medium to be wound by the medium take-up unit (to-be-wound portion) drops to a temperature lower than the glass transition point.

Forming the overcoat layer may be usefully employed in, for example, printed matters for advertising or other purposes. A suitable example of media for such an intended use may be a medium that can be wound into roll form when printing is over. Using any medium as such, the organic solvent included in the ink discharged from the overcoat head may desirably be sufficiently removed before the medium starts to be wound. To this end, the medium may desirably be heated sufficiently by the downstream heater such as the after heater, before the medium starts to be wound.

The formation of the overcoat layer such as a clear ink layer may need a sufficiently large quantity of ink applied in order to adequately improve the overcoat layer in weather resistance. To completely remove the organic solvent from the overcoat layer without sacrificing a desired printing speed, it may be necessary to raise the heating temperature of the after heater.

The inventors, through their keen studies and tests, found out that winding the hot medium was fraught with problems including the occurrence of blocking in the wound medium. As used herein, the blocking refers to the situation where, among printed media stacked in layers, an ink on a medium at least partly adheres to the back surface of another medium in contact with the ink, and an attempt to remove the adhered ink causes a printed surface to be peeled off. The blocking may also be used to express the occurrence of bleed-through.

The inventors further tackled the occurrence of problems including blocking, and found out that blocking often occurred when the temperature of the overcoat layer at the time of winding the medium was as high as the glass transition point or even higher. This finding led them to the idea of suppressing the occurrence of blocking by controlling the temperature of the overcoat layer at the time of winding the medium to stay below the glass transition point. This configuration may effectively suppress the occurrence of blocking likely to occur even with media to be wound into roll form when printing is over, contributing to favorable formation of the overcoat layer.

The temperature of the overcoat layer at the time of winding the medium may be adequately decreased by placing a time interval long enough before the medium heated by the downstream heater (for example, after heater) starts to be wound. To this effect, specifically, it may be contemplated to secure an adequate transport distance of the medium between the downstream heater and the medium take-up unit. It may also be contemplated to lower the temperature of the overcoat layer using, for example, a cooling fan after being heated by the downstream heater.

[Configuration 10]

The printing device further includes: a powdering device disposed between the downstream heater and the medium take-up unit, the powdering device being provided to apply a powdered material to the medium before being wound by the medium take-up unit. The powdering device preferably applies the powdered material to the medium after the temperature of the overcoat layer drops to a lower temperature than the glass transition point.

The inventors, in their continued efforts, further found out that applying the powdered material to the medium shortly before arriving at a winding position of the medium take-up unit more effectively suppressed the occurrence of blocking. It may be facilitated by employing this means to wind the medium after the overcoat layer is formed thereon.

The powdered material may preferably have particle sizes less than or equal to 10 μm. Suitable examples of the powdered material may include starch and silica in powdered form.

[Configuration 11]

A printing device for performing printing by ink-jet technique, including: a color ink head being an inkjet head that forms a color ink layer on a medium using a color ink; and an overcoat head being an inkjet head that forms an overcoat layer that covers the color ink layer, wherein the overcoat head discharges ink droplets of an ink containing an organic solvent and an ultraviolet absorbent that absorbs ultraviolet rays.

With this configuration, as compared to using inks of ultraviolet curing type as the overcoat layer ink, additives added to the ink may be reduced to an appropriate extent. In addition to that, the overcoat layer may be further improved in strength. The ultraviolet absorbent-containing ink may effectively reduce possible damage to the overcoat layer caused by ultraviolet rays. In addition to that, the overcoat layer may be further improved in weather resistance.

According to this configuration wherein the ultraviolet absorbent-containing ink is used, the overcoat layer thereby formed, even if reduced in thickness, may still excel in weather resistance. When drying is employed, instead of using the curing agent, to increase the overcoat layer in hardness, the overcoat layer may be dried and formed within a reasonable time frame for practical use.

[Configuration 12]

A printing method for performing printing by ink-jet technique, the method including: using a color ink head being an inkjet head that forms a color ink layer on a medium using a color ink; using an overcoat head being an inkjet head that forms an overcoat layer that covers the color ink layer; and using a curing agent head being an inkjet head that discharges ink droplets of a curing agent, the curing agent being a liquid for curing an ink in the overcoat layer, wherein the overcoat head discharges ink droplets of an ink prepared by dispersing in an organic solvent a curable material that is cured in reaction to the curing agent. The method according to this configuration may produce effects similar to the configuration 1.

[Configuration 13]

A printing method for performing printing by ink-jet technique, the method including: using a color ink head being an inkjet head that forms a color ink layer with a color ink on a medium; and using an overcoat head being an inkjet head that forms an overcoat layer that covers the color ink layer, wherein the overcoat head discharges ink droplets of an ink containing an organic solvent and an ultraviolet absorbent that absorbs ultraviolet rays. The method according to this configuration may produce effects similar to the configuration 11.

Advantageous Effects of Invention

According to the present invention, the overcoat layer, when formed by ink-jet technique, may be formed of an ink consisting of more suitable ingredients.

BRIEF DESCRIPTION OF DRAWINGS

FIG. 1A is a side view of the printing device 10, illustrating its main structural elements by way of an example. FIG. 1B is a top view of the printing device 10, illustrating its main structural elements by way of an example. FIG. 1C is a drawing of ink layers formed by the printing device 10, illustrated by way of an example.

FIG. 2 is a table showing, by way of an example, detailed compositions of clear inks (base material) and of curing agents used in an example of the present invention.

FIGS. 3A and 3B are illustrations relating to an experiment performed to study properties of overcoat layers 104 formed at different base material-curing agent mixing ratios. FIG. 3A shows printing conditions employed in the experiment. FIG. 3B is a table showing the experiment result.

FIG. 5A shows a result of measured temperature distribution of the medium 50 in the event of a short distance between the after-heating unit 36 and a winding roller 42. FIG. 5B shows a result of measured temperature distribution of the medium 50 in the event of an extended distance between the after-heating unit 36 and the winding roller 42.

FIG. 6A is a drawing illustrating an example of the whole structure of the printing device 10. FIG. 6B is a drawing of a powdering device 60 of the printing device 10, illustrated by way of an example.

FIG. 7A is a side sectional view of the serial powdering unit 62. FIG. 7B is a top view of the serial powdering unit 62.

DESCRIPTION OF EMBODIMENTS

Figure 1A:
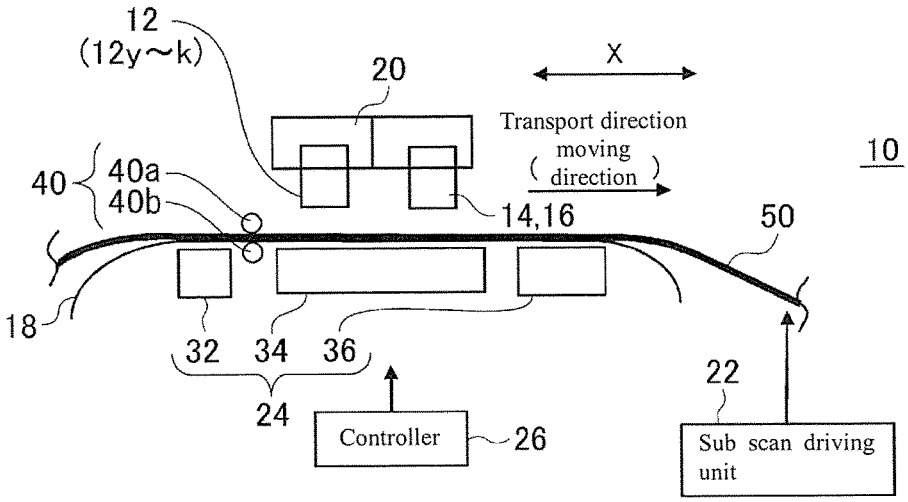
FIGS. 1A to 1C are drawings illustrating an example of a printing device 10 according to an embodiment of the present invention.
Figure 1B:
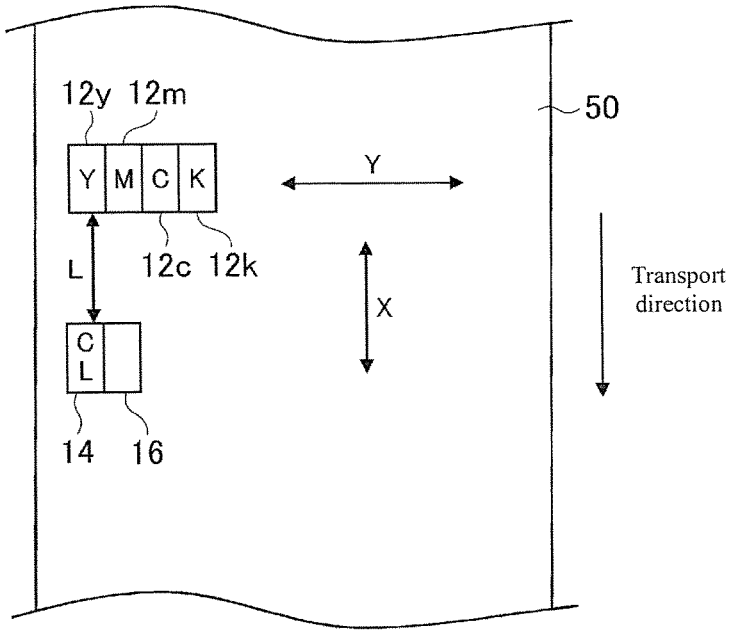
Figure 1C:
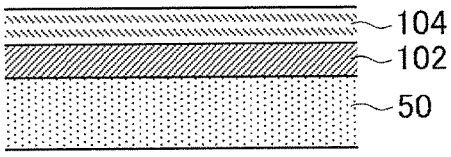

Hereinafter embodiments according to the present invention are described in detail with reference to the accompanying drawings. FIGS. 1A to 1C are drawings illustrating an example of a printing device 10 according to an embodiment of the present invention. FIG. 1A is a side view of the printing device 10, illustrating its main structural elements by way of an example. FIG. 1B is a top view of the printing device 10, illustrating its main structural elements by way of an example. FIG. 1C is a drawing of ink layers formed by the printing device 10, illustrated by way of an example.

In an example hereinafter described, a printing device 10 is an inkjet printer for performing printing on a medium 50 by ink-jet technique, including a plurality of inkjet heads, a controller 26, a platen 18, a main scan driving unit 20, a sub scan driving unit 22, and a heater 24. The inkjet heads may include color ink heads 12*y*, 12*m*, 12*c*, and 12*k* (hereinafter, collectively color ink heads 12*y*-*k*), a clear ink head 14, and a curing agent head 16.

The color ink heads 12*y*-*k* are each an inkjet head that forms on the medium 50 a color ink layer 102 that is an ink layer formed of a color ink. In this example, the color ink heads 12*y*-*k* discharge ink droplets of Y, M, C, and K color inks, respectively. A suitable example of each Y, M, C, and K color ink may be a solvent ink. The solvent ink may refer to an ink containing a solvent, specifically, an organic solvent. The organic solvent may be a hydrophobic organic solvent, for example. The organic solvent may be a volatile organic solvent.

Other possible examples of the color inks may include latex inks and solvent UV inks. The latex ink contains a polymer material and a solvent and is dried to fix the polymer material on a medium. The solvent UV ink contains a material of ultraviolet curing type (for example, monomer or oligomer) and a solvent, specifically, an organic solvent.

The color ink heads 12*y*-*k* according to this example are arranged next to one another in the printing device 10 in a predefined main scanning direction (Y direction in the drawing). The color ink heads 12*y*-*k* in this arrangement discharge ink droplets on the same region on the medium 50 in each main scan. The main scan may refer to an operation in which each inkjet head discharges ink droplets while moving in the main scanning direction.

The clear ink head 14 is described as an example of the overcoat head. The clear ink head 14 discharges ink droplets of an ink (base material), which is the material of the overcoat layer 104, on the color ink layer 102 formed by the color ink heads 12*y*-*k*. The overcoat head may refer to an inkjet head that forms the overcoat layer 104 as an ink layer that covers the color ink layer 102. The overcoat layer 104 may be an ink layer that covers and protects the color ink layer 102.

In this example, the overcoat layer 104 may be a colorless, transparent layer formed of a clear ink. The clear ink used as the material of the overcoat layer 104 is curable when mixed with a predefined curing agent. The clear ink may refer to a colorless, transparent ink. This ink is more specifically an ink prepared by dispersing in an organic solvent a curable material curable in reaction to a curing agent.

In this example, the ink used as the material of the overcoat layer 104 may be a solvent ink containing a hydrophobic organic solvent. This ink may preferably be an ink including an organic solvent as a main ingredient. The ink including an organic solvent as a main ingredient may refer to an ink containing an organic solvent in a content of greater than or equal to 50% by weight.

In this example, the clear ink head 14 is disposed at a position displaced from the color ink heads 12*y-k* in a sub scanning direction (X direction in the drawing) orthogonal to the main scanning direction. During each of the main scans performed by the color ink heads 12*y-k*, the clear ink head 14 moves with the color ink heads 12*y-k* in the main scanning direction to perform a main scan as well. The clear ink head 14, in each main scan, discharges ink droplets of the clear ink on the color ink layer 102 formed by the color ink heads 12*y-k*. Accordingly, the overcoat layer 104 may be favorably formed on the color ink layer 102.

In this example, the clear ink head 14 is disposed at a position away by, for example, a distance L as illustrated in the drawing from the color ink heads 12*y-k* in the sub scanning direction. This may advantageously secure an adequately long time interval (time lag) before the clear ink is discharged on the color ink layer 102 formed at each of target positions on the medium 50. The time lag may be lengthened or shortened as desired by optionally adjusting the distance L. With such adjustability of the time lag, the color ink layer 102 may be fully dried as desired before the clear ink is deposited thereon. This may further advantageously form the overcoat layer 104 favorably on the color ink layer 102 without redissolving the ink forming the color ink layer 102.

The curing agent head 16 is an inkjet head that discharges droplets of a curing agent, liquid formulation for curing the ink of the overcoat layer 104. The curing agent head 16 is disposed alongside the overcoat head in the main scanning direction. In this example, the curing agent is a chemical agent for curing the clear ink used as the base material of the overcoat layer 104. During each of the main scans performed by the clear ink head 14, the curing agent head 16 moves with the clear ink head 14 in the main scanning direction to perform a main scan as well. This may advantageously allow the clear ink droplets and curing agent droplets to be discharged on the same region in one main scan. In addition to that, each main scan may provide for adequate contact between the curing agent and the clear ink still undried, allowing the clear ink to be properly curable.

In case the discharge of the clear ink droplets and the discharge of the curing agent droplets are performed separately in different main scans for regions on the medium 50, and for example, the clear ink used is a highly volatile ink applied in advance of the curing agent, the clear ink may possibly be dried too soon to be mixed with the curing agent. Therefore, as described in this example, the clear ink droplets and the curing agent droplets are most desirably discharged at once in one main scan. More specific features of the clear ink and the curing agent will be described later in further detail.

The controller 26 may be the CPU of the printing device 10 that controls the structural elements of the printing device 10. The platen 18 is a table-like member on which the medium 50 is situated so as to face the color ink heads 12*y-k*, clear ink head 14, and curing agent head 16. The main scan driving unit 20 is a driver that drives the color ink heads 12*y-k*, clear ink head 14, and curing agent head 16 to perform the main scans. The main scan driving unit 20 may be equipped with a carriage that holds the color ink heads 12*y-k*, clear ink head 14, and curing agent head 16, and a guide rail that moves the carriage in the main scanning direction.

The sub scan driving unit 22 is a driver that drives the color ink heads 12*y-k*, clear ink head 14, and curing agent head 16 to perform the sub scans. The sub scan may refer to an operation in which each inkjet head moves relative to the medium 50 in the sub scanning direction orthogonal to the main scanning direction. The sub scan driving unit 22 may be, for example, a roller that transports the medium 50.

The sub scan driving unit 22 may drive the color ink heads 12*y-k*, clear ink head 14, and curing agent head 16 to perform the sub scans at intervals between the main scans. The color ink heads 12*y-k* repeatedly perform the main scans and the sub scans to discharge the ink droplets at each of target positions on the medium 50. In each main scan, the clear ink head 14 and the curing agent head 16 perform the main scans for a region where the main scans by the color ink heads are already completed, thereby forming the overcoat layer 104 on the color ink layer 102.

The heater 24 is a heating means that heats the medium 50 to dry the ink on the medium 50. In this example, the heater 24 includes a pre-heating unit 32, a platen heating unit 34, and an after-heating unit 36. The pre-heating unit 32 is disposed more upstream than the color ink heads 12*y-k* in the transport direction of the medium 50. This heating unit heats each target position on the medium 50 before the ink droplets discharged from the color ink heads 12*y-k* land thereon. The platen heating unit 34 heats the medium 50 at a position facing the color ink heads 12*y-k*, clear ink head 14, and curing agent head 16. This heating unit heats the medium 50 at the landing positions of the ink droplets discharged from the inkjet heads. The heater 24, using these heating units, heats at least a first landing position on the medium of the ink droplets discharged from the color ink heads 12*y-k* and a second landing position on the medium of the ink droplets discharged from the clear ink head 14. The after-heating unit 36 is a downstream heater disposed more downstream than the clear ink head 14 and the curing agent head 16 in the transport direction of the medium 50. This heating unit heats a region on the medium 50 where the color ink layer 102 and the overcoat layer 104 have been formed. The heating treatment thus performed may allow the respective positions on the medium 50 to be adequately heated.

Here, drying of the inks is described in further detail. The color inks discharged from the color ink heads 12*y-k* and the clear ink discharged from the clear ink head 14, which are both solvent inks, are fixable on the medium 50 by drying. Then, the heater 24 heats the medium 50 to remove by volatilization the organic solvent contained in the ink of the color ink layer 102 and in the ink of the overcoat layer 104.

In order to prevent smearing of the ink in the color ink layer 102, the ink may desirably be dried immediately after the ink droplets have landed on the medium. To quickly dry the ink, therefore, the heating temperature at the first landing position of the color inks is desirably a high temperature at or above a certain degree.

In this example, a monochrome clear ink is used to form the overcoat layer 104. Hence, the overcoat layer 104 may be free from the problem of smearing and accordingly dried over time in contrast to the color inks. In case the heating temperature at the ink droplet landing position is too high when curing the clear ink with the aid of the curing agent as described in this example, the ink may be dried too soon to be adequately mixed with the curing agent. Then, curing of the ink in the overcoat layer 104 may be inadequate.

To avoid that, the heater 24 in this example may heat the medium 50 in a manner that the temperature at the clear ink landing position (second landing position) stays below the temperature at the color ink landing position. This may effectively prevent that the clear ink is dried before being mixed with the curing agent. Then, complete cure of the clear ink thereby effectuated may enable the overcoat layer 104 that excels in weather resistance to be favorably formed.

According to this example wherein the clear ink is cured in reaction to the curing agent, the overcoat layer 104 that excels in weather resistance may be speedily formed. As compared to using inks of ultraviolet curing type as the overcoat layer ink, using the solvent clear ink to form the overcoat layer 104 may reduce additives added to the ink to an appropriate extent. In addition to that, the overcoat layer 104 may be further improved in strength. Hence, the overcoat layer 104, when formed by ink-jet technique, may be formed of an ink consisting of more suitable ingredients. The printed surface with the color ink layer 102 formed thereon may be thereby well-protected to prevent discoloration and/or damage. Forming the colorless, transparent overcoat layer 104 on the color ink layer may also conduce to a more lustrous appearance and an improved image quality.

In this example wherein the overcoat layer 104 may be cured in a short time, the overcoat layer 104 may be advantageously increased in thickness. Specifically, for example, a plurality of main scans (for example, two main scans) may be performed on each region on the medium 50 by the clear ink head 14 and the curing agent head 16 to form a plurality of (for example, two) overcoat layers 104. The overcoat layers 104 thus consisting of plural layers may be further improved in weather resistance.

Depending on a total number of the overcoat layers 104 desirably formed, the clear ink head 14 and the curing agent head 16 may preferably be increased in length in the sub scanning direction than the color ink heads 12*y-k*. Then, these heads may accordingly enable plural overcoat layers 104 to be favorably formed on a single color ink layer 102.

In this example wherein the color ink layer 102 and the overcoat layer 104 are both formed during the main scans, these two layers may be favorably formed in one step by discharging the color inks and the clear ink simultaneously. This, for example, may save the labor of resetting the medium 50 to form the overcoat layer 104 after the color ink layer 102 is formed. Further advantageously, the ink-jet technique employed to form the overcoat layer 104 may avoid overuse of the material of the overcoat layer 104, allowing the overcoat layer 104 to be favorably formed in an even thickness on accurately targeted regions alone. This example thus advantageous may successfully form the overcoat layer 104 with high accuracy without an unnecessary cost increase.

As described, this example, by suitably adjusting the distance L between the color ink heads 12*y-k* and the clear ink head 14 and the curing agent head 16, produces a time lag before the clear ink starts to be spread on the color ink layer 102, thereby affording complete cure of the color ink in advance of depositing the clear ink thereon. This may further advantageously suppress the risk of smearing in the color ink layer 102.

To this effect, higher heating temperatures of the heater 24 may be contemplated to serve the purpose of smear resistance in the color ink layer 102. To be specific, adequate heating using the pre-heating unit 32 of the heater 24 may increase the heating temperature at the color ink landing position (first landing position) to higher degrees. In this instance, at the clear ink landing position (second landing position) distant from the pre-heating unit 32, the medium 50 may be heatable at lower temperatures than at the first landing position. This may effectively prevent the clear ink from drying, while suppressing smearing of the color ink.

Optionally, the platen heating unit 34 may be located so as to face the color ink heads 12*y-k* but so as not to face the clear ink head 14. In this instance, the medium may be directly heated at the color ink landing position alone, whereas the medium may be heated at the clear ink landing position by remaining heat. In this optional structure, the medium may be heatable at the clear ink landing position at lower temperatures than the color ink landing position.

To ensure that the overcoat layer 104 is sufficiently dried, it may be contemplated to change an amount of time it takes for the medium 50 to move past the heater 24 depending on the quantity of the clear ink discharged. Supposing that the clear ink is discharged in a greater quantity to improve the overcoat layer 104 in weather resistance, the clear ink may possibly be not dry enough in case the medium 50 quickly moves past the heater 24 for high-speed printing. To avoid that, it may be contemplated to configure a variable printing speed or a variable length (length in the sub scanning direction) of a region to be heated by the heater 24, thereby changing a length of heating time suitably for the quantity of the clear ink discharged. This may ensure that the overcoat layer 104 is adequately dried.

Next, specific features of the clear ink and the curing agent used in this example are hereinafter described in further detail. The overcoat layer 104 may be improved in weather resistance by increasing the quantity of the material ink of this layer. When the ink quantity is increased, the ink used may preferably be superior in dryness. Examples of the organic solvent usable in the clear ink for the clear ink head 14 (base material) may include organic solvents selected from Hazardous Materials, Category IV, Class II petroleums specified in the Fire Service Act. The solvent for the curing agent may be one of the organic solvents selected from the Class II petroleums. By selecting the organic solvent from these examples, the organic solvent in the ink, even if applied in a large quantity, may be removed by volatilization in a shorter period of time.

In this example, the overcoat layer 104 may be a two-part curable layer. Specifically, the clear ink and the curing agent are discharged through different nozzles (nozzles of different inkjet heads) and then mixed and cured on the medium 50. Therefore, the clear ink containing any one of organic solvents selected from the Class II petroleums characterized by high volatility may be prevented from curing on the nozzle surfaces, and may be speedily curable on the medium 50.

FIG. 2 is a table showing, by way of an example, detailed compositions of clear inks (base material) and of curing agents used in this example. As illustrated in the drawing, the ink for the clear ink head 14 in this example (base material) may be a suitable one selected from inks containing acrylic resins as their curable materials, for example, modified acrylic-based inks. The curing agent for the curing agent head 16 may be a suitable one selected from polymer-based curing agents. By using such inks and materials, the overcoat layer 104 that excels in weather resistance may be quickly dried and favorably formed.

The overcoat layer 104 may be formed otherwise. For example, the overcoat layer 104 may be formed of a two-part curable resin curable in reaction to a curing agent. Examples of such a resin may include urethane resins and epoxy resins. In this instance, the ink for the clear ink head 14 (base material) may be a suitable one selected from inks containing urethane resins or epoxy resins as their curable materials. By using such inks and materials, the overcoat layer 104 that excels in weather resistance may be quickly dried and favorably formed.

When an organic solvent selected from the Class II petroleums characterized by high volatility is used in a two-part curable composition, it is still possible that the ink is dried and hardened near the nozzles of the clear ink head 14, clogging the nozzles. Therefore, it may be contemplated to use, as the organic solvent added to the clear ink for the clear ink head 14, one of organic solvents selected from Hazardous Materials, Category IV, Class III petroleums specified in the Fire Service Act. By thus using an organic solvent similar to the ones used in the known solvent inks, the ink droplets may be reliably dischargeable. The evaporation rate of the organic solvent in the ink may be decelerated to prevent the ink from drying near the nozzles of the clear ink head 14.

To further improve the overcoat layer 104 in weather resistance, adverse effects imposed on the surface of a printed matter by ultraviolet rays may desirably be reduced in consideration of possible outdoor display. To further improve the overcoat layer 104 in weather resistance, the ink for the clear ink head 14 may preferably be selected from inks containing ultraviolet absorbents that absorb ultraviolet rays. Then, the overcoat layer 104 may be further improved in weather resistance.

In case the ink contains too much of the ultraviolet absorbent, the overcoat layer 104 may be inferior in strength. Some of the ultraviolet absorbents may generate heat through absorption of ultraviolet rays. The generated heat may adversely affect the weather resistance of an obtained printed matter. The content of the ultraviolet absorbent may preferably be approximately 1% (for example, approximately 0.1 to 3%, or preferably approximately 0.5 to 1.5%).

The ultraviolet absorbent may be mixed with a curing agent instead of the ink for the clear ink head 14. In this instance, the curing agent head 16 discharges ink droplets of the curing agent mixed with the ultraviolet absorbent. When the ultraviolet absorbent is mixed with the curing agent, the overcoat layer 104 containing the ultraviolet absorbent may be favorably formed likewise. Also, the overcoat layer 104 may be further improved in weather resistance.

When the ultraviolet absorbent-containing ink is used to form the overcoat layer 104, the overcoat layer 104 thereby formed, if reduced in thickness, may still excel in weather resistance. When employing drying instead of using the curing agent to increase the overcoat layer 104 in hardness, therefore, the overcoat layer 104 thus thinned may be dried and formed within a reasonable time frame for practical use. When the ultraviolet absorbent-containing ink is used to form the overcoat layer 104, it may be contemplated to form the overcoat layer 104 otherwise instead of the two-part curable composition.

Next, mixing ratios of the clear ink and the curing agent are hereinafter described in further detail. To desirably shorten the curing time of the overcoat layer 104 and improve the coating performance of the overcoat layer 104 including in weather resistance, it is necessary to thoroughly mix the clear ink, or base material, with the curing agent. This example, wherein the base material and the curing agent are discharged by ink-jet technique, may enable accurate control of the quantity of droplets to be discharged. This example, therefore, may succeed in shortening the curing time and may yet obtain the overcoat layer 104 that excels in coating performance including weather resistance.

The inventors observed through an experiment different effects upon the curability (dryness) and weather resistance of the overcoat layer 104 over different mixing ratios of the clear ink, or base material, and the curing agent. The test performed is hereinafter described.

FIGS. 3A and 3B are illustrations relating to an experiment performed to study properties of overcoat layers 104 formed at different base material-curing agent mixing ratios. FIG. 3A shows printing conditions employed in the experiment.

The "pre", "print", and "after" shown in the heating temperature of the printing conditions are respectively the heating temperatures of the pre-heating unit 32, platen heating unit 34, and after-heating unit 36 illustrated in FIGs. 1A to 1C. The "adding extra layer-once " refers to the formation of the overcoat layer 104 consisting of two ink layers. Specifically, two main scans; forward scan and backward scan, were performed at positions on the medium, and the base material and the curing agent were discharged in each main scan to form the two-layered overcoat layer 104. The overcoat layer 104 thereby formed was twice as thick as the color ink layer 102 consisting of a single layer. The thickness of the color ink layer 102 was approximately 1.5 μm, and the thickness of the overcoat layer 104 was approximately 3 μm.

FIG. 3B is a table showing the experiment result. The "blocking" in this test result represents the dryness evaluation of the overcoat layers 104. To evaluate the blocking, media each coated with an overcoat layer 104 were stacked in layers and left at rest, and then removed from one another. This evaluation teaches that the overcoat layer 104 poorly dried (cured) may be peeled off.

As shown in the table, in the evaluation of blocking, among the media stacked in layers under no-load condition, the overcoat layers 104 containing the curing agent by 15% or less relative to the base material were not peeled off and evaluated as acceptable. On the other hand, the overcoat layers 104 containing the curing agent by 20% or more were peeled off and evaluated as unacceptable. For evaluation under more strict conditions, the overcoat layers 104 were subject to load and evaluated. As a result, the overcoat layer containing no curing agent was evaluated as unacceptable, while the overcoat layers containing the curing agent by 5 to 15% alone were evaluated as acceptable.

The "one-year long weather resistance test" of the experiment result in connection with the coating condition of the overcoat layer 104 was a test performed to check weather resistance equivalent to a year under ultraviolet irradiation. This test demonstrated that the overcoat layer 104 containing the curing agent by 10% or less underwent multiple irregularities on their surfaces, exhibiting poor weather resistance. The test further demonstrated that the irregularities were lessened with an increased content of the curing agent. Adding the curing agent by 15% or more (15 to 20%) was proven to produce weather resistance high enough to pass the one-year long weather resistance test.

It was learnt from the experiment result that the overcoat layers 104 containing too little or too much of the curing agent resulted in poor dryness (curability) or weather resistance. This outcome may be attributed to poor curability of the overcoat layer 104 resulting from shortage of the curing agent and adverse effects caused by ingredients left unreacted in the oversupplied curing agent. The mixing ratios of the base material (clear ink) and the curing agent may preferably be adjusted depending on compositions employed.

This example, wherein the base material and curing agent are discharged by ink-jet technique as described earlier, may enable accurate control of the quantity of droplets to be discharged. Therefore, the base material and the curing agent may be appropriately combined and applied to form the overcoat layer 104 in accordance with preset mixing ratios. This may enable the overcoat layer 104 that excels in weather resistance to be favorably and quickly formed.

Figure 4:
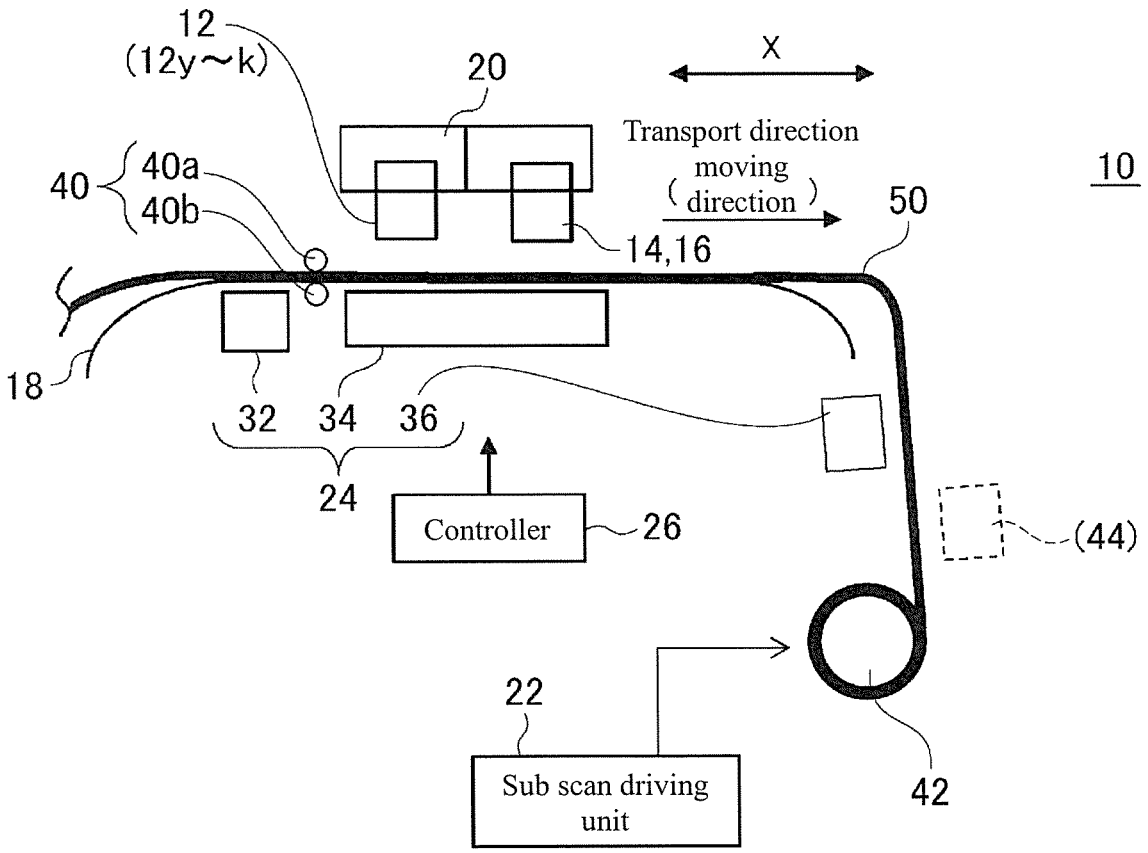
FIG. 4 is a drawing of a further example of the printing device 10, illustrating its main structural elements by way of an example.

Hereinafter, the printing device 10 is specifically described with reference to an example different from the example illustrated in FIGS. 1A to 1C. FIG. 4 is a drawing of a further example of the printing device 10, illustrating its main structural elements by way of an example. Except for the additional features described below, the printing device 10 illustrated in FIG. 4 is identical or similar to the printing device 10 illustrated in FIGS. 1A to 1C. For example, the printing device 10 according to this example illustrated in FIG. 4 forms the color ink layer 102 and the overcoat layer 104 on the medium 50 in an overlapping manner identically or similarly to the illustration of FIG. 1C.

The printing device 10 in this example uses a medium 50 wound into roll form when the printing is over. The printing device 10 may form the overcoat layer 104 on a printed matter for advertising or other purposes. In contrast to the structure illustrated in FIGS. 1A to 1C, the printing device 10 using such a medium 50 is further equipped with a winding roller 42. The winding roller 42 is described as an example of the medium take-up unit. The winding roller 42 winds up the medium 50 more downstream than the after-heating unit 36 in the transport direction of the medium 50. The after-heating unit 36 is described as an example of the downstream heater. This heating unit heats the medium 50 more downstream than the clear ink head 14 and the curing agent head 16 in the transport direction.

In this example, the sub scan driving unit 22 rotates the winding roller 42 to let this roller wind up the medium 50, thereby moving the medium 50 relative to the clear ink head 14 and the curing agent head 16. In connection with this movement, a transport roller 40 functions as an example of the medium transport unit to transport the medium 50. The transport roller 40 may include a driven roller 40*a* and a driving roller 40*b*. The medium 50 is transported being held vertically between these rollers. This may allow the color ink layer 102 and the overcoat layer 104 to be favorably formed on the medium 50 wound into roll form after printing.

In this example, the after-heating unit 36 heats the medium 50 in a manner that the temperature of the overcoat layer 104 is higher than or equal to a glass transition point. Rephrasing for clarity "the temperature of the overcoat layer 104 is high than or equal to a glass transition point", the material of the overcoat layer 104 (for example, acrylic resin) cured in reaction to the curing agent has a temperature higher than or equal to the glass transition point of the material used. Then, the organic solvent contained in the ink discharged from the clear ink head 14 may be substantially removed before the medium starts to be wound.

A definition of the glass transition point may be a temperature Tg at which an amorphous solid material undergoes glass transition. The glass transition point may be more specifically a temperature at which such a change as glass transition occurs in an amorphous solid material made of a material which is almost as hard as crystal and substantially having no fluidity at low temperatures but is lowered by heating in rigidity and viscosity with an increased fluidity within a narrow range of temperatures. At higher temperatures than the glass transition point, the solid material may be liquefied or become rubbery. As for the material of the overcoat layer 104, its glass transition point can be known from an experiment. As for some of the materials usable to form the overcoat layer 104, their theoretical values may be calculated by computations. In this example, the glass transition point may be approximately 70° C.

In this example, the winding roller 42 winds up the medium 50 heated by the after-heating unit 36 and then transported to a position distant by a predefined distance. The winding roller 42 may accordingly wind up the medium 50 in which the temperature of the overcoat layer 104 has dropped to a temperature lower than the glass transition point. This may effectively suppress the occurrence of blocking in the wound medium. Therefore, the overcoat layer 104 may be more favorably formed on the medium 50 wound into roll form when printing is over.

In this example, by keeping a distance long enough between the after-heating unit 36 and the winding roller 42, the temperature of the overcoat layer 104 at the time of winding the medium may drop to adequately low temperatures. To decrease the temperature of the overcoat layer 104, a cooling fan 44, for example, may be disposed between the after-heating unit 36 and the winding roller 42 as illustrated with a broken line in FIG. 4. Providing this means may ensure that the temperature of the overcoat layer 104 decreases more reliably in case only a short interval is available between the after-heating unit 36 and the winding roller 42.

Figure 5A:
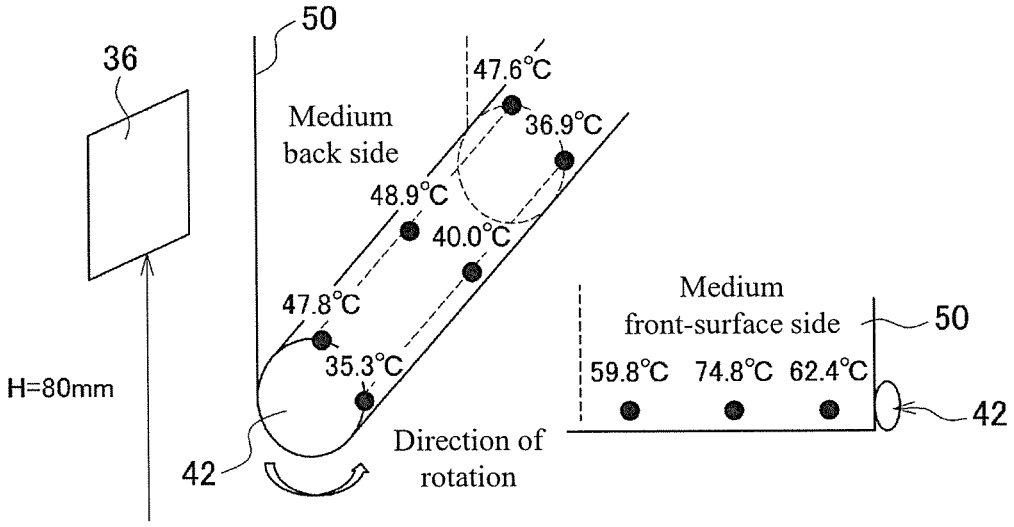
FIGS. 5A and 5B are illustrations showing results of an experiment performed in which media 50 were respectively wound in roll form after being heated by an after-heating unit 36.
Figure 5B:
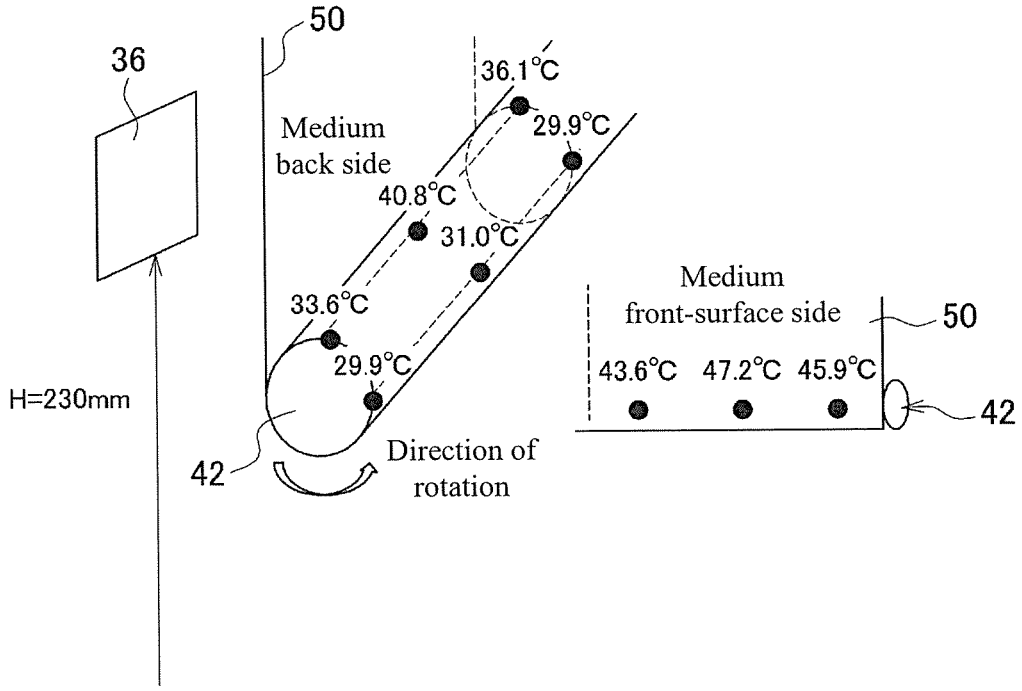

An experiment performed by the inventors is hereinafter described. This experiment was performed in connection with the structural features of the printing device 10 illustrated in FIG. 4. FIGS. 5A and 5B shows the results of the experiment performed in which the medium 50 was wound by the roller after being heated by the after-heating unit 36. FIG. 5A shows a result of measured temperature distribution of the medium 50 in the event of a short distance between the after-heating unit 36 and a winding roller 42. FIG. 5B shows a result of measured temperature distribution of the medium 50 in the event of an extended distance between the after-heating unit 36 and the winding roller 42.

The printing resolution in this experiment was 540×1080 dpi. This experiment employed multi-pass printing with the number of passes set to 12 or 24. With the number of passes set to 12, the printing speed is 3.0 $m^2$/h, and the quantity of the clear ink discharged is 33 cc/$m^2$. With the number of passes set to 24, the printing speed is 1.5 $m^2$/h, and the quantity of the clear ink discharged is equal to the quantity with 12 passes (33 cc/$m^2$). The number of passes, 24, therefore, slows down the transport speed of the medium 50 as compared to 12 passes, affording more cooling time.

The medium 50 was transported from the after-heating unit 36 to the winding roller 42 substantially vertically downward. A height H of the after-heating unit 36 from the winding position of the winding roller 42 is 80 mm in the result illustrated in FIG. 5A, and 230 mm in the result illustrated in FIG. 5B. The number of passes was 12 in the result of FIG. 5A, wherein the transport speed of the medium 50 was higher, and the distance between the after-heating unit 36 and the winding roller 42 was shorter, resulting in a higher temperature of the medium 50 when wound by the roller. The number of passes was 24 in the result of FIG. 5B, wherein the transport speed of the medium 50 was lower, and the distance between the after-heating unit 36 and the winding roller 42 was longer, resulting in a lower temperature of the medium 50 when wound by the roller.

The curing agents and the base materials of the overcoat layer 104 used had the same compositions described with reference to FIG. 2. This experiment was performed in any other configurations similarly or identically to the experiment described with reference to FIGS. 3A and 3B. FIGS. 5A and 5B show the temperatures of the medium 50 measured at different positions on the winding roller 42 when printing was performed under the conditions described above.

On left sides of FIGS. 5A and 5B are shown temperature measurement results of the medium 50 at positions seen from the back-surface side of the medium 50 transported (medium back side). The back-surface side of the medium 50 transported refers to the back-surface side of the medium 50 at a position before the medium 50 is wound by the winding roller 42. In this example, the back-surface side of the medium 50 refers to a surface side opposite to the surface of the medium 50 on which the overcoat layer 104 is fouled.

On right sides of FIGS. 5A and 5B are shown temperature measurement results of the medium 50 at positions of sections unseen on the left sides. The unseen sections on the left sides of these drawings refer to parts of the medium 50 near a position at which its front-surface side (medium front side) arrives at the medium take-up unit 42. In this example, the front-surface side of the medium 50 refers to a side of the medium 50 facing the after-heating unit 36.

According to the temperature measurement result at these positions illustrated in FIG. 5A, the temperature of the overcoat layer 104 was as high as the glass transition point or even higher in at least a part of the medium 50 at the winding position. This medium was wound by the roller. Then, the occurrence of blocking was observed at multiple sections of this medium. Therefore, it is fair to say that the experiment conditions of FIG. 5A are inadequate to properly form the overcoat layer 104 on the medium 50 printed and wound.

According to the temperature measurement result of different positions on the medium 50 at the winding position illustrated in FIG. 5B, the temperature of the overcoat layer 104 was lower than the glass transition point at all positions on the medium 50. This medium was wound likewise, in which the occurrence of blocking was not observed. This experiment demonstrated that adequately decreasing the temperature of the medium 50 at the to-be-wound portion was very effective for blocking control. It was further learnt from this experiment that the printing device 10 structured as described with reference to FIG. 4 was well-equipped to favorably form the overcoat layer 104 on the medium 50 printed and wound.

The distance between the after-heating unit 36 and the winding roller 42 and the number of passes were changed to further perform the experiment at high and low temperatures of the medium 50 when wound by the roller. The distance and the pass number are examples of parameters to regulate the temperatures of the medium 50 and the overcoat layer 104 at the to-be-wound portion. The important factor for blocking control may be, as described earlier, the temperature of the overcoat layer 104 at the to-be-wound portion.

Even when, for example, the height H of the after-heating unit 36 is increased, the occurrence of blocking is still possible if the medium 50 is transported at a high transport speed. Even when the height H is decreased, the occurrence of blocking may be controllable in case the transport speed of the medium 50 is slow enough. As a specific example to this effect, blocking occurred, in the experiment performed by the inventors, at a few positions under the conditions H=230 mm and the printing pass number=12. Even when the height H is decreased to 80 mm, the occurrence of blocking may be well-controllable in case the printing pass number is 24. Therefore, the position of the after-heating unit 36 and the transport speed of the medium 50 may preferably be adjusted suitably for the other parameters of printing conditions.

Figure 6A:
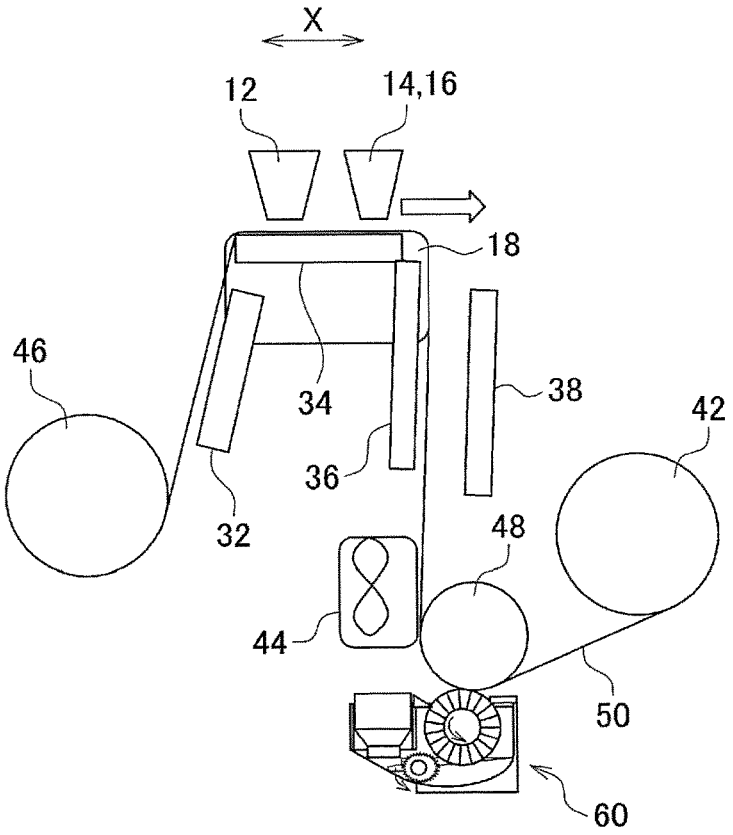
FIGS. 6A and 6B are drawings of a yet further example of the printing device 10, illustrating its main structural elements by way of an example.
Figure 6B:
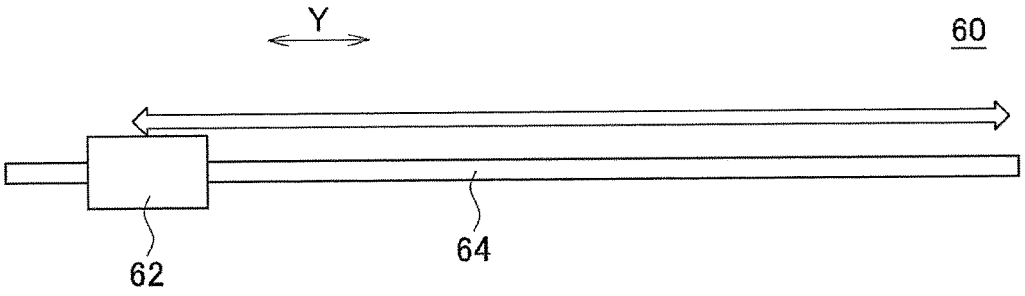

Subsequently, a yet further example of the printing device 10 is specifically described. FIGS. 6A and 6B are drawings of a yet further example of the printing device 10, illustrating its main structural elements by way of an example. FIG. 6A is a drawing of the whole structure of the printing device 10. FIG. 6B is a drawing of a powdering device 60 of the printing device 10, illustrated by way of an example. The printing device 10 illustrated in FIGS. 6A and 6B includes color ink heads 12, a clear ink head 14, a curing agent head 16, a platen 18, a pre-heating unit 32, a platen heating unit 34, an after-heating unit 36, a far infrared heater 38, a winding roller 42, a cooling fan 44, a feed roller 46, an inter-stage roller 48, and a powdering device 60.

Except for the additional features described below, the printing device 10 illustrated in FIGS. 6A and 6B is identical or similar to the printing device 10 described with reference to FIGS. 1A to 1C, FIG. 2, FIGS. 3A and 3B, FIG. 4, and FIGS. 5A and 5B. For example, the printing device 10 according to this example illustrated in FIGS. 6A and 6B forms an color ink layer and a overcoat layer on the medium 50 in an overlapping manner identically or similarly to the illustration of FIG. 1C. Except for the additional features described below, the structural elements illustrated in FIGS. 6A and 6B with the same reference signs as in FIGS. 1A to 1C, FIG. 2, FIGS. 3A and 3B, FIG. 4, and FIGS. 5A and 5B are identical or similar to the ones illustrated in these drawings. As with the printing device 10 of FIGS. 1A to 1C, the printing device 10 of FIGS. 6A and 6B further has a main scan driving unit 20, a sub scan driving unit 22, and a controller 26, though not illustrated in FIGS. 6A and 6B to simplify the illustration.

The inventors, through their continued studies, found out that the occurrence of blocking was well-controllable by applying a powdered material to the medium 50 heated and wound by the medium take-up unit such as the winding roller 42 right before the winding position. Then, the inventors configured the printing device as illustrated in FIGS. 6A and 6B to be useful to this effect.

With reference to FIGS. 6A and 6B, the printing device 10 further has, unlike the device of FIG. 4, the far infrared heater 38, feed roller 46, powdering device 60, and inter-stage roller 48. Of these additional structural elements, the far infrared heater 38 and the feed roller 46 may also be usable in the device illustrated in FIG. 4.

The far infrared heater 38 heats the medium 50 with no contact with the medium 50. The far infrared heater 38 is disposed so as to face the printed surface of the medium 50. This heater heats the medium 50 on which the overcoat layer has been formed by the clear ink head 14 and the curing agent head 16. Then, the organic solvent contained in the ink discharged from the clear ink head 14 may be suitably removed before the medium starts to be wound.

The feed roller 46 is a roller on which the unprinted medium 50 is wrapped around. The feed roller 46 is disposed more upstream than the color ink head 12 in the transport direction of the medium 50 to unwind and feed the medium 50 to the position of the color ink head 12. The feed roller 46 may be configured to unwind the medium 50 in a length equal to a length of the medium 50 that has been wound by then by the winding roller 42.

Of the structural elements illustrated in FIGS. 6A and 6B, the powdering device 60 is a device installed to apply a powdered material to the medium 50. The powdering device 60 is disposed between the heater and the winding roller 42 to apply the powdered material to the medium 50 before being wound by the winding roller 42. In this instance, the powdering device 60 may apply the powdered material to the medium 50 after the temperature of the overcoat layer 104 drops to a lower temperature than the glass transition point.

With reference to FIGS. 6A and 6B, the printing device 10 has the pre-heating unit 32, platen heating unit 34, after-heating unit 36, and far infrared heater 38, and uses these heating units to heat the medium 50. In connection with "between the heater and the winding roller 42" in the earlier description, it refers to an interval between the winding roller 42 and the downstream heater that heats the medium 50 at a most downstream position in the transport direction of the medium 50.

As illustrated in FIG. 6B, the powdering device 60 has a serial powdering unit 62 and a shaft 64. The serial powdering unit 62 (powder sprayer), while moving in the main scanning direction (Y direction), applies the powdered material to the medium 50. The serial powdering unit 62 may apply the powdered material, for example, while reciprocating along the shaft 64. The powdered material may preferably have particle sizes less than or equal to 10 μm. Suitable examples of the powdered material may include starch and silica in powdered form. The serial powdering unit 62 is more specifically described later. The shaft 64 serves to guide the movement of the serial powdering unit 62 along the main scanning direction. The powdering device 60 thus configured serially applies the powdered material to target sections on the medium 50.

In the printing device illustrated in FIGS. 6A and 6B, the inter-stage roller 48 supports the medium 50 at a position facing the powdering device 60. The inter-stage roller 48 rotates while holding the medium 50 against the powdering device 60. The inter-stage roller 48 may be a driven roller rotated in response to the movement of the medium 50. As a result, the powdered material may be more properly applied to the medium 50.

As with the printing device illustrated in FIG. 4, the printing device of FIGS. 6A and 6B may use the cooling fan 44 for cooling the medium 50 heated by the downstream heater. In the structure wherein the powdered material is applied to the medium 50, the cooling fan 44 may preferably be disposed at a position at which the medium 50 can be cooled before the powdered material is applied thereto.

The powdered material to be applied to the medium 50 may be applied to either one of the printed surface (front surface) or the back surface of the medium 50. The cooling fan 44 may preferably be disposed closer to the surface of the medium 50 to which the powdered material is applied. The cooling fan thus disposed may adequately cool the medium 50 before the powdered material is applied to the medium 50. Specifically, FIGS. 6A and 6B illustrate the structure wherein the powdered material is applied to the back surface of the medium 50. The cooling fan 44 may preferably be disposed on the back-surface side of the medium 50.

Figure 7A:
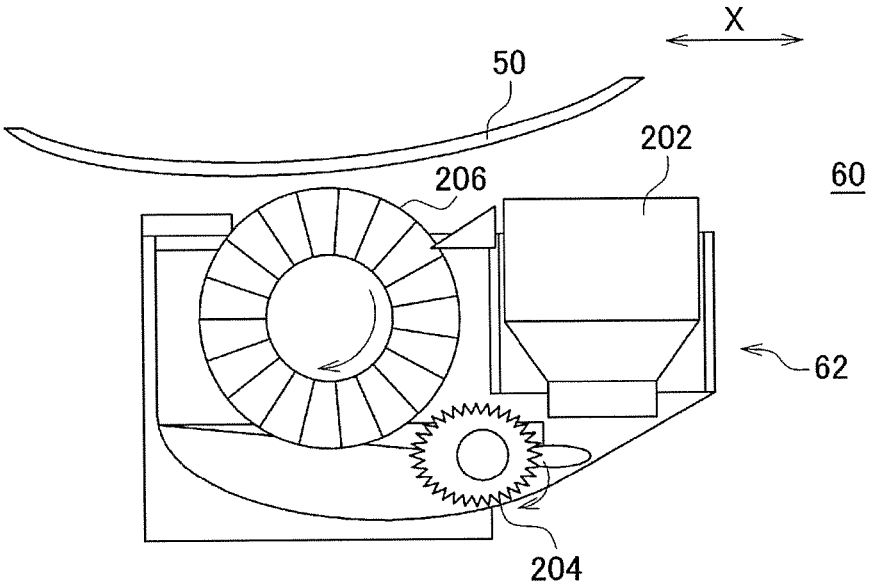
FIGS. 7A and 7B are drawings, illustrating in further detail a serial powdering unit 62 by way of an example.
Figure 7B:
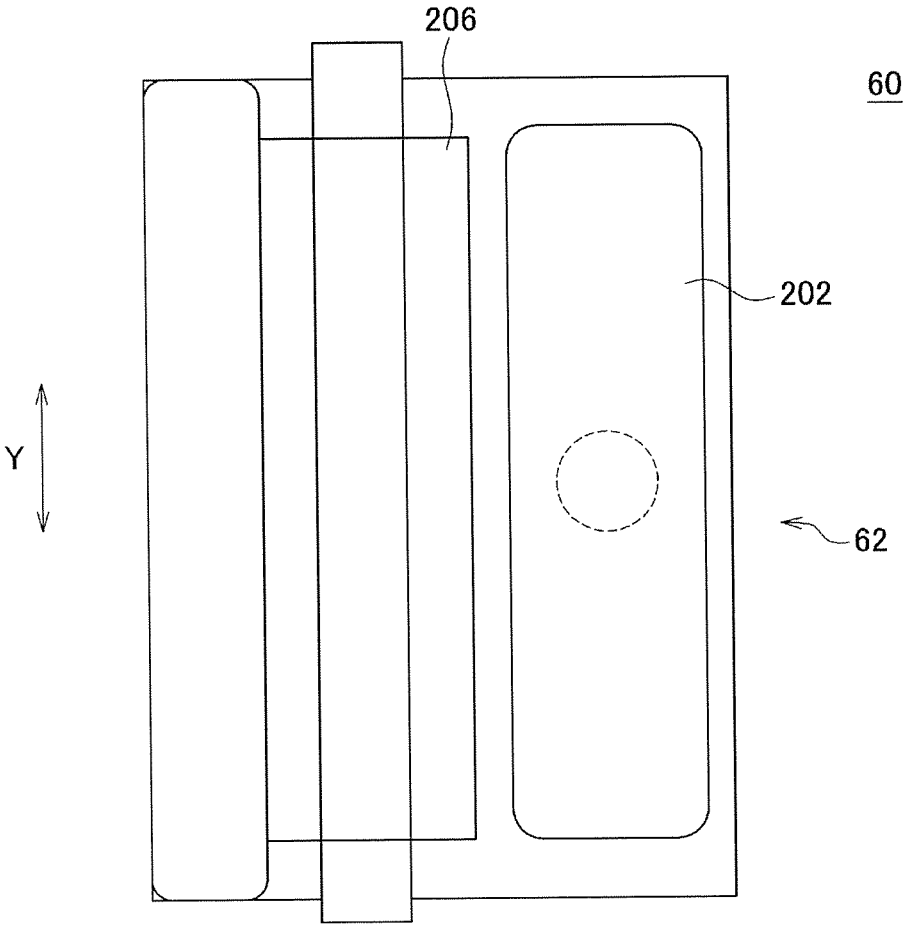

The serial powdering unit 62 of the powdering device 60 is described in further detail. FIGS. 7A and 7B are drawings, illustrating in further detail the serial powdering unit 62 by way of an example. FIG. 7A is a side sectional view of the serial powdering unit 62. This drawing illustrates, by way of an example, the serial powdering unit 62 in cross section on a plane orthogonal to the medium 50 at a position at which the powdered material is applied to the medium. FIG. 7B is a top view of the serial powdering unit 62. This drawing illustrates, by way of an example, the serial powdering unit 62 viewed from the medium-50 side. The serial powdering unit 62 illustrated in these drawings has a powdered material container 202, a feeding and stirring roller 204, and a powdering roller 206.

The powdered material container 202 contains therein the powdered material to be applied to the medium 50. This container successively feeds the feeding and stirring roller 204 with the powdered material. The powdered material container 202 may preferably be a replaceable container. The feeding and stirring roller 204 successively feeds the powdering roller 206 with the powdered material from the powdered material container 202. This roller detects any shortage of the powdered material to be applied by the powdering roller 206. Then, this roller, for example, rotates or vibrates to replenish the shortage. Suitable example of the feeding and stirring roller 204 may include rollers with lateral grooves or oblique slits formed therein, and spiral rollers.

The powdering roller 206 serves as a roller that applies the powdered material to the medium 50. Suitable examples of the powdering roller 206 may include fabric rollers and bristle brush rollers. The bristle brush roller may be a roller having a toothbrush-like surface. The powdering roller 206 may, for example, rotate or move in a motion in which rotation and longitudinal vibration are combined to thereby apply the powdered material to the medium 50.

The powdering roller thus configured may properly apply the powdered material to the medium 50 after the overcoat layer is formed thereon. Further advantageously, the occurrence of blocking in the wound medium may be effectively suppressed. It may be facilitated by employing this means to wind the medium 50 after the overcoat layer is formed thereon.

Conventionally, a large printed matter to be later wound into successive layers may be protected with a film-like laminate. Using the powdered material as described makes it difficult for the powder-applied medium to be covered with a film-like laminate conventionally available. This example, however, forms the overcoat layer using the clear ink head 14 and the curing agent head 16 before applying the powdered material. This overcoat layer may reliably protect a printed matter in place of such a film-like laminate. Such a well-protected printed matter may be directly placed outdoors or in locations where the printed matter is exposed to contact with people. Further, applying the powdered material may advantageously protect the printed matter from stains including fingerprints.

It may be particularly preferable to apply the powdered material under the conditions below. The powdering device 60 may preferably be operable in synchronization with the printing speed of the color ink heads 12 and/or possibly other heads, wherein the serial powdering unit 62 moves at least once or more over the printed regions on the medium 50. Further preferably, the serial powdering unit 62 may move over the regions at least twice or more.

In consideration of any displacement in the sub scanning direction between the positions of the color ink heads 12 and the position of the powdering device 60, the operation of the serial powdering unit 62 may preferably be performed later by an amount of time corresponding to the displacement than the main scans of the color ink heads 12. It may be desirable to avoid that the oversupplied powdered material adheres to the medium 50, roughening the printed surface of the medium 50. To this end, the serial powdering unit 62 may preferably be disposed more rearward than a position at which 85% or more of the ink solvent (water-laden) on the medium 50 is evaporated (position on the downstream side in the transport direction of the medium 50). The ink solvent on the medium 50 may refer to vaporizable solvent ingredients contained in the color ink layer and the overcoat layer. The quantity of the solvent (vehicle) evaporated may be measurable based on the rate of loss in weight of the solvent on the medium 50.

With reference to FIGS. 6A and 6B, the medium 50, before the powdered material is applied thereto, is cooled by the cooling fan 44. A yet further example of the printing device 10 may further include, other than the cooling fan 44, an air cooling means or a heat sink disposed on the back-surface side of the medium 50.

In the example so far described, the powdered material is applied to the back surface of the medium 50. It may be contemplated, however, to apply the powdered material to the printed surface of the medium 50. Structural features for applying the powdered material to the printed surface of the medium 50 are hereinafter described.

Figure 8:
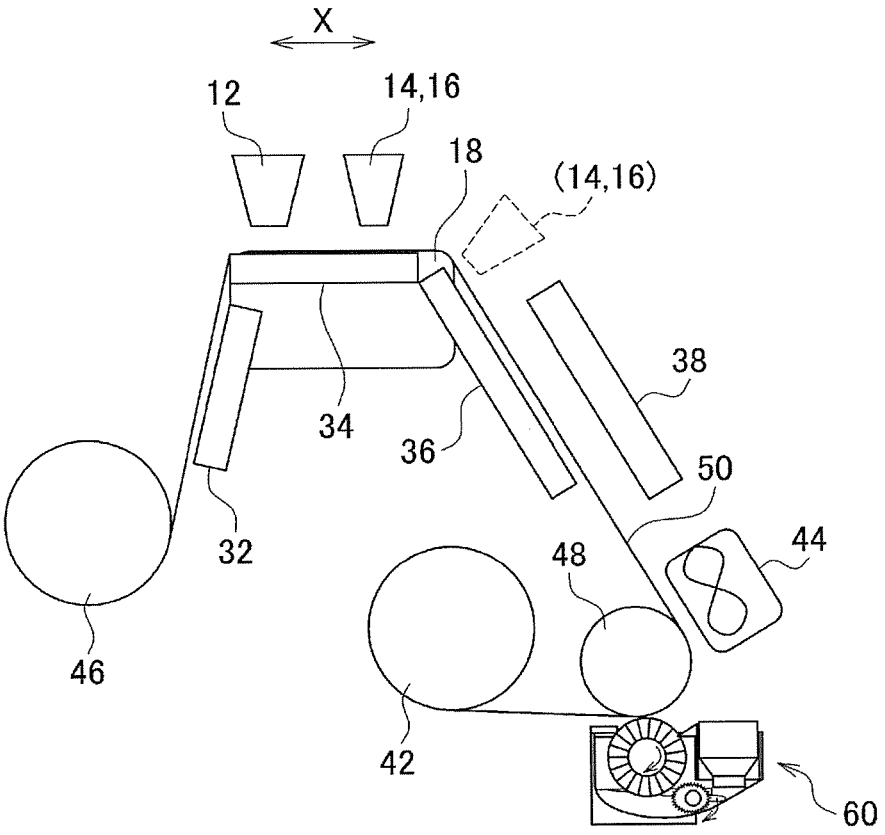
FIG. 8 is a drawing of a yet further example of the printing device 10, illustrating its structural features by way of an example.

FIG. 8 is a drawing of a yet further example of the printing device 10, illustrating, by way of an example, its main structural elements for applying the powdered material to the printed surface of the medium 50. Except for the additional features described below, the printing device 10 illustrated in FIG. 8 is identical or similar to the printing device 10 described with reference to FIGS. 1A to 1C, FIG. 2, FIGS. 3A and 3B, FIG. 4, FIGS. 5A and 5B, FIGS. 6A and 6B, and FIGS. 7A and 7B. Except for the additional features described below, the structural elements illustrated in FIG. 8 with the same reference signs as FIGS. 6A and 6B are identical or similar to the ones illustrated in FIGS. 6A and 6B.

The printing device illustrated in FIG. 8 applies the powdered material to the printed surface of the medium 50. The inter-stage roller 48 supports the medium 50 such that the printed surface of the medium 50 faces the powdering device 60, and the powdering device 60 applies the powdered material to the printed surface of the medium 50. In the printing device illustrated in FIG. 8, the cooling fan 44 is disposed at a position closer to the printed surface of the medium 50 to which the powdered material is to be applied. The cooling fan thus disposed may properly cool the surface of the medium 50 to which the powdered material is to be applied.

The powdering device thus configured may be allowed to properly apply the powdered material to the medium 50 after the overcoat layer is formed thereon. Further advantageously, the occurrence of blocking in the wound medium may be effectively suppressed. It may be facilitated by employing this means to wind the medium 50 after the overcoat layer is formed thereon.

The printing device 10 may be structurally modified as described below. As illustrated with a broken line in FIG. 8, the clear ink head 14 and the curing agent head 16 may be more distantly spaced from the color ink heads 12. Such a positional relationship between these heads is not necessarily employed in the printing device illustrated in FIG. 8 alone, and may also be employed in the printing devices structured as described with reference to FIGS. 1A to 1C, FIG. 2, FIGS. 3A and 3B, FIG. 4, FIGS. 5A and 5B, FIGS. 6A and 6B, and FIGS. 7A and 7B.

As a result, the overcoat layer may be formed after the color ink layer formed by the color ink heads 12 is fully dried. Rephrasing for clarity "after the color ink layer formed by the color ink heads 12 is fully dried", after the ink droplets discharged from the color ink heads 12 have landed on the medium 50, enough time passes and an image rendered by the color ink heads 12 is no longer smeared with the liquid discharged from the clear ink head 14 and the curing agent head 16. This may more specifically refer to a condition in which 20% or more of the solvent has been evaporated from the ink droplets that have just landed on the medium. Then, the overcoat layer may be more favorably formed on the color ink layer.

The inks discharged from the color ink heads 12 are not limited to any particular colors. The colors may be Y, M, C, and K, or may further include white, metallic colors, pearl-like colors, and fluorescent colors. The color ink heads that render an image under the overcoat layer may be, instead of inkjet heads for color inks (color ink heads), a monochrome inkjet head.

Thus far was described the embodiments of the present invention. However, the technical scope of the present invention is not necessarily limited to the described embodiments. Those skilled in the art should obviously understand that the embodiments may be subject to various changes or improvements. As is clearly understood from the appended claims, such changes or improvements are naturally included in the technical scope of the present invention.

INDUSTRIAL APPLICABILITY

The technology disclosed herein may be suitably applicable to printing devices.

The invention claimed is:

1. A printing device for performing printing by ink-jet technique, and the printing device comprising:

a color ink head, being an inkjet head that forms a color ink layer on a medium using a color ink;

an overcoat head, being an inkjet head that forms an overcoat layer that covers the color ink layer; and a curing agent head, being an inkjet head that discharges ink droplets of a curing agent, the curing agent being a liquid for curing an ink in the overcoat layer, wherein the overcoat head discharges ink droplets of an ink prepared by dispersing in an organic solvent a curable material that is cured in reaction to the curing agent;

the color ink head discharges ink droplets at positions on a medium by repeatedly performing a main scan in which the color ink head discharges ink droplets while moving in a main scanning direction previously set and a sub scan in which the color ink head moves relative to the medium in a sub scanning direction orthogonal to the main scanning direction; and the overcoat head and the curing agent head perform the main scan and the sub scan simultaneously with the color ink head, and in each main scan, the main scan is performed by the overcoat head and the curing agent head on a region where the main scan by the color ink head has been completed, and ink droplets of a clear ink and droplets of the curing agent are ejected, and the printing device further comprising:

a heater, heating the medium so as to remove the organic solvent from the ink in the overcoat layer by volatilization, wherein the color ink used in the color ink head is fixable on the medium by drying, the heater heats at least a first landing position being a landing position on the medium of the ink droplets discharged from the color ink head and a second landing position being a landing position on the medium of the ink droplets discharged from the overcoat head, and the medium is heated so that a temperature at the second landing position is lower than a temperature at the first landing position.

2. The printing device according to claim 1, wherein the overcoat head discharges ink droplets of a solvent ink including a hydrophobic organic solvent.

3. The printing device according to claim 2, wherein the overcoat head discharges ink droplets of a colorless and transparent ink.

4. The printing device according to claim 1, wherein the overcoat head discharges ink droplets of a colorless and transparent ink.

5. The printing device according to claim 1, wherein the overcoat head discharges ink droplets of an ink including an ultraviolet absorbent that absorbs ultraviolet rays.

6. The printing device according to claim 1, wherein the curing agent head discharges ink droplets of the curing agent mixed with an ultraviolet absorbent that absorbs ultraviolet rays.

7. The printing device according to claim 1, wherein the overcoat head discharges ink droplets of an ink including an acrylic resin as the curable material, and the curing agent head discharges droplets of the curing agent containing a polymer-based curing agent.

8. The printing device according to claim 1, wherein the overcoat head is disposed at a position displaced from the color ink head in the sub scanning direction, and the curing agent head is disposed alongside the overcoat head in the main scanning direction.

9. The printing device according to claim 1, further comprising:

a medium transport unit, transporting the medium, and the medium transport unit moves the medium relative to the overcoat head and the curing agent head, a downstream heater, heating the medium at a downstream side compared to the overcoat head and the curing agent head in a transport direction in which the medium is transported by the medium transport unit; and a medium take-up unit, winding up the medium at a downstream side compared to the downstream heater in the transport direction, wherein the downstream heater heats the medium so that the overcoat layer has a temperature higher than or equal to a glass transition point, and the medium take-up unit winds up the medium after the temperature of the overcoat layer has decreased to a temperature lower than the glass transition point.

10. The printing device according to claim 9, further comprising:

a powdering device, being disposed between the downstream heater and the medium take-up unit, the powdering device being provided to apply a powdered material to the medium before being wound by the medium take-up unit.

11. A printing device for performing printing by ink-jet technique, and the printing device comprising:

a color ink head, being an inkjet head that forms a color ink layer on a medium using a color ink;

an overcoat head, being an inkjet head that forms an overcoat layer that covers the color ink layer; and a curing agent head, being an inkjet head that discharges ink droplets of a curing agent, the curing agent being a liquid for curing an ink in the overcoat layer, wherein the overcoat head discharges ink droplets of an ink prepared by dispersing in an organic solvent a curable material that is cured in reaction to the curing agent; and, the printing device further comprising:

a heater, heating the medium so as to remove the organic solvent from the ink in the overcoat layer by volatilization, wherein the color ink used in the color ink head is fixable on the medium by drying, the heater heats at least a first landing position being a landing position on the medium of the ink droplets discharged from the color ink head and a second landing position being a landing position on the medium of the ink droplets discharged from the overcoat head, and the medium is heated so that a temperature at the second landing position is lower than a temperature at the first landing position.

12. A printing method for performing printing by ink-jet technique, and the printing method comprising:

using a color ink head, being an inkjet head that forms a color ink layer on a medium using a color ink;

using an overcoat head, being an inkjet head that forms an overcoat layer that covers the color ink layer; and using a curing agent head, being an inkjet head that discharges droplets of a curing agent, the curing agent being a liquid for curing an ink in the overcoat layer, wherein the overcoat head discharges ink droplets of an ink prepared by dispersing in an organic solvent a curable material that is cured in reaction to the curing agent;

the color ink head discharges ink droplets at positions on a medium by repeatedly performing a main scan in which the color ink head discharges ink droplets while moving in a main scanning direction previously set and a sub scan in which the color ink head moves relative to the medium in a sub scanning direction orthogonal to the main scanning direction; and, the overcoat head and the curing agent head perform the main scan and the sub scan simultaneously with the color k head, and in each main scan, the main scan is performed by the overcoat head and the curing agent head on a region where the main scan by the color ink head has been completed, and ink droplets of a clear ink and droplets of the curing agent are ejected, and the printing method further comprising:

providing a heater, heating the medium so as to remove the organic solvent from the ink in the overcoat layer by volatilization, wherein the color ink used in the color ink head is fixable on the medium by drying, the heater heats at least a first landing position being a landing position on the medium of the ink droplets discharged from the color ink head and a second landing position being a landing position on the medium of the ink droplets discharged from the overcoat head, and the medium is heated so that a temperature at the second landing position is lower than a temperature at the first landing position.

13. The printing method according to claim 12, wherein the overcoat head discharges ink droplets of an ink including an organic solvent and an ultraviolet absorbent that absorbs ultraviolet rays.

* * * * *